US012359542B2

(12) United States Patent
Rudic et al.

(10) Patent No.: US 12,359,542 B2
(45) Date of Patent: Jul. 15, 2025

(54) AUTONOMOUS INFLOW CONTROL DEVICE SYSTEM AND METHOD

(71) Applicant: Schlumberger Technology Corporation, Sugar Land, TX (US)

(72) Inventors: Aleksandar Rudic, Houston, TX (US); Gocha Chochua, Sugar Land, TX (US); Amrendra Kumar, Missouri City, TX (US); Joshua Montanez, Houston, TX (US); Michael Dean Langlais, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 18/560,296

(22) PCT Filed: Apr. 28, 2022

(86) PCT No.: PCT/US2022/026632
§ 371 (c)(1),
(2) Date: Nov. 10, 2023

(87) PCT Pub. No.: WO2022/240589
PCT Pub. Date: Nov. 17, 2022

(65) Prior Publication Data

US 2024/0271509 A1 Aug. 15, 2024

Related U.S. Application Data

(60) Provisional application No. 63/187,724, filed on May 12, 2021.

(51) Int. Cl.
*E21B 43/12* (2006.01)
*E21B 34/08* (2006.01)

(52) U.S. Cl.
CPC ..... *E21B 43/12* (2013.01); *E21B 34/08* (2013.01)

(58) Field of Classification Search
CPC ..... E21B 43/12; E21B 34/08
See application file for complete search history.

(56) References Cited

U.S. PATENT DOCUMENTS 3,267,946 A 8/1966 Adams
4,206,783 A 6/1980 Brombach
(Continued)

FOREIGN PATENT DOCUMENTS

EP 1672167 A1 6/2006
NO 20120872 A1 8/2012
(Continued)

OTHER PUBLICATIONS

International Search Report and Written Opinion issued in the PCT Application PCT/US2022/026632, dated Aug. 11, 2022 (11 pages).
(Continued)

*Primary Examiner* — Steven A MacDonald
(74) *Attorney, Agent, or Firm* — Jeffrey D. Frantz

(57) ABSTRACT

A technique facilitates the inflow of desired fluids into a downhole well completion while restricting the inflow of undesirable fluids. The technique utilizes at least one autonomous inflow control device which is placed along a well completion to control inflow of fluid from an exterior to an interior of the well completion. The autonomous inflow control device utilizes a plurality of shiftable elements which automatically shift in their relative positions based on the density of fluid in the autonomous inflow control device. This automatic shifting causes the alignment or misalignment of flow openings so as to allow free flow of a desired
(Continued)

fluid through the autonomous inflow control device and into the interior of the completion while automatically restricting flow of an undesirable fluid.

17 Claims, 4 Drawing Sheets

(56) References Cited

U.S. PATENT DOCUMENTS

| | | | | |
|---|---|---|---|---|
| 4,333,499 | A | 6/1982 | Beck | |
| 4,364,232 | A | 12/1982 | Sheinbaum | |
| 5,303,782 | A | 4/1994 | Johannessen | |
| 6,082,455 | A | 7/2000 | Pringle | |
| 6,786,285 | B2 | 9/2004 | Johnson et al. | |
| 7,409,999 | B2 * | 8/2008 | Henriksen | E21B 34/10 166/330 |
| 8,534,355 | B2 | 9/2013 | Johannesen | |
| 8,616,290 | B2 * | 12/2013 | Dykstra | E21B 34/08 166/250.15 |
| 8,622,136 | B2 * | 1/2014 | Dykstra | E21B 34/08 251/12 |
| 8,708,050 | B2 * | 4/2014 | Dykstra | E21B 43/12 166/250.15 |
| 8,752,629 | B2 | 6/2014 | Moen | |
| 8,757,266 | B2 * | 6/2014 | Dykstra | E21B 34/08 251/12 |
| 8,866,317 | B2 | 10/2014 | Ocalan | |
| 8,875,797 | B2 | 11/2014 | Aakre et al. | |
| 8,931,566 | B2 | 1/2015 | Dykstra et al. | |
| 8,985,222 | B2 * | 3/2015 | Dykstra | E21B 34/08 166/250.15 |
| 9,279,309 | B2 | 3/2016 | Werswick et al. | |
| 9,353,608 | B2 | 5/2016 | Johannessen | |
| 9,453,395 | B2 * | 9/2016 | Fripp | E21B 43/12 |
| 9,556,706 | B1 | 1/2017 | Zhao | |
| 9,624,759 | B2 * | 4/2017 | Mathiesen | E21B 43/122 |
| 9,683,429 | B2 | 6/2017 | Mathiesen et al. | |
| 9,896,906 | B2 * | 2/2018 | Tunkiel | E21B 34/08 |
| 10,145,223 | B2 | 12/2018 | Moen | |
| 10,597,984 | B2 | 3/2020 | Moen | |
| 10,704,359 | B2 | 7/2020 | Fripp | |
| 10,822,920 | B2 | 11/2020 | Killie | |
| 10,871,057 | B2 | 12/2020 | Chochua | |
| 11,041,361 | B2 * | 6/2021 | Fripp | E21B 34/08 |
| 11,506,016 | B2 * | 11/2022 | AlAdawy | F16K 31/12 |
| 2002/0108755 | A1 | 8/2002 | Zisk | |
| 2006/0027377 | A1 | 2/2006 | Schoonderbeek | |
| 2006/0076150 | A1 * | 4/2006 | Coronado | E21B 43/32 166/250.15 |
| 2006/0086498 | A1 | 4/2006 | Wetzel | |
| 2006/0113089 | A1 * | 6/2006 | Henriksen | E21B 43/12 166/321 |
| 2006/0131033 | A1 | 6/2006 | Bode | |
| 2008/0149323 | A1 | 6/2008 | O'Malley | |
| 2009/0000787 | A1 | 1/2009 | Hill | |
| 2009/0133869 | A1 | 5/2009 | Clem | |
| 2009/0166045 | A1 | 7/2009 | Wetzel | |
| 2009/0218103 | A1 | 9/2009 | Aakre | |
| 2010/0059221 | A1 | 3/2010 | Vannuffelen | |
| 2011/0079384 | A1 | 4/2011 | Russell | |
| 2011/0186300 | A1 | 8/2011 | Dykstra | |
| 2011/0198097 | A1 | 8/2011 | Moen | |
| 2011/0266001 | A1 * | 11/2011 | Dykstra | E21B 34/08 166/330 |
| 2012/0048563 | A1 | 3/2012 | Holderman | |
| 2012/0061088 | A1 | 3/2012 | Dykstra | |
| 2012/0145385 | A1 | 6/2012 | Lopez | |
| 2012/0152527 | A1 | 6/2012 | Dykstra | |
| 2013/0048299 | A1 | 2/2013 | Fripp | |
| 2013/0068467 | A1 | 3/2013 | Zhou | |
| 2013/0092381 | A1 * | 4/2013 | Dykstra | E21B 34/08 166/319 |
| 2013/0092382 | A1 * | 4/2013 | Dykstra | E21B 34/08 166/321 |
| 2013/0092392 | A1 * | 4/2013 | Dykstra | E21B 43/12 166/373 |
| 2013/0092393 | A1 * | 4/2013 | Dykstra | E21B 34/08 166/373 |
| 2013/0186634 | A1 | 7/2013 | Fripp et al. | |
| 2013/0299198 | A1 | 11/2013 | Gano | |
| 2014/0041731 | A1 * | 2/2014 | Fripp | E21B 43/12 137/13 |
| 2014/0216733 | A1 * | 8/2014 | Mathiesen | E21B 43/32 166/252.5 |
| 2014/0231095 | A1 | 8/2014 | Lopez | |
| 2014/0246206 | A1 | 9/2014 | Least et al. | |
| 2014/0290776 | A1 | 10/2014 | Dykstra | |
| 2015/0021019 | A1 | 1/2015 | Veit | |
| 2015/0040990 | A1 | 2/2015 | Mathiesen et al. | |
| 2015/0060084 | A1 | 3/2015 | Moen et al. | |
| 2015/0308226 | A1 | 10/2015 | Killie | |
| 2016/0230509 | A1 | 8/2016 | Lopez | |
| 2017/0096860 | A1 | 4/2017 | Zhou | |
| 2020/0064871 | A1 | 2/2020 | Fripp | |
| 2020/0095851 | A1 * | 3/2020 | Stojkovic | E21B 43/12 |
| 2021/0002978 | A1 | 1/2021 | Killie | |
| 2022/0112790 | A1 * | 4/2022 | Cho | E21B 43/12 |

FOREIGN PATENT DOCUMENTS

| | | | |
|---|---|---|---|
| WO | 2009079612 | A1 | 6/2009 |
| WO | 2009088292 | A1 | 7/2009 |
| WO | 2010059062 | A1 | 5/2010 |
| WO | 2011095512 | A2 | 8/2011 |
| WO | 2011100176 | A1 | 8/2011 |
| WO | 2012095196 | A2 | 7/2012 |
| WO | 2013130096 | A1 | 9/2013 |
| WO | 2013139601 | A2 | 9/2013 |
| WO | 2014116237 | A1 | 7/2014 |
| WO | 2017053335 | A1 | 3/2017 |
| WO | 2020046135 | A1 | 3/2020 |

OTHER PUBLICATIONS

DAR Technologies, https://www.innowell.no/, downloaded on Nov. 7, 2023 (3 pages).

* cited by examiner

AUTONOMOUS INFLOW CONTROL DEVICE SYSTEM AND METHOD

CROSS-REFERENCE TO RELATED APPLICATIONS

The present application is a national stage entry under 35 U.S.C. 371 of International Application No. PCT/US2022/026632, filed Apr. 28, 2022, which claims priority benefit of U.S. Provisional Application No. 63/187,724, filed May 12, 2021, the entirety of which is incorporated by reference herein and should be considered part of this specification.

BACKGROUND

In a variety of well applications, horizontal wellbores are drilled and utilized to enhance oil production. Horizontal wells increase reservoir contact which can provide enhanced recovery of oil relative to other types of wells such as vertical wells. However, horizontal wells are susceptible to coning in which unwanted fluids, e.g. gas and water, interfere with production and reduce oil recovery. In some cases, the presence of the unwanted fluids can lead to early well abandonment. Inflow control devices are sometimes installed along a completion string to equalize the production influx across completion sections and to thus prolong the production of oil. However, once coning occurs, conventional inflow control devices may be inadequate in choking back the unwanted fluids.

Certain types of autonomous inflow control devices have been developed to choke back unwanted fluids to a greater extent than conventional inflow control devices. However, existing autonomous inflow control devices have a variety of limitations including bulkiness, excessive moving parts, lack of wellsite adjustability, lack of flow performance predictability, and susceptibility to erosion. Many autonomous inflow control devices adjust to choke back unwanted fluid based on a viscosity contrast between wanted fluids and unwanted fluids. For example, light or heavy oils may have substantially higher viscosity compared to gas or water at downhole conditions. However, some of the wanted and unwanted fluids, e.g. ultra-light oil and water, have comparable viscosities. Consequently, the autonomous inflow control devices provide poor performance in distinguishing such fluids autonomously.

SUMMARY

In general, a system and methodology facilitate the inflow of wanted or desired fluids into a downhole well completion while restricting the inflow of unwanted or undesirable fluids. The technique utilizes at least one autonomous inflow control device which is placed along a well completion, e.g. along a base pipe of the well completion, to control inflow of fluid from an exterior to an interior of the well completion. The autonomous inflow control device utilizes a plurality of shiftable elements which automatically shift in their relative positions based on the density of fluid in the autonomous inflow control device. This automatic shifting of the shiftable elements causes the alignment or misalignment of flow openings so as to allow free flow of a desired fluid through the autonomous inflow control device and into the interior of the completion while automatically restricting flow of an undesirable fluid.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
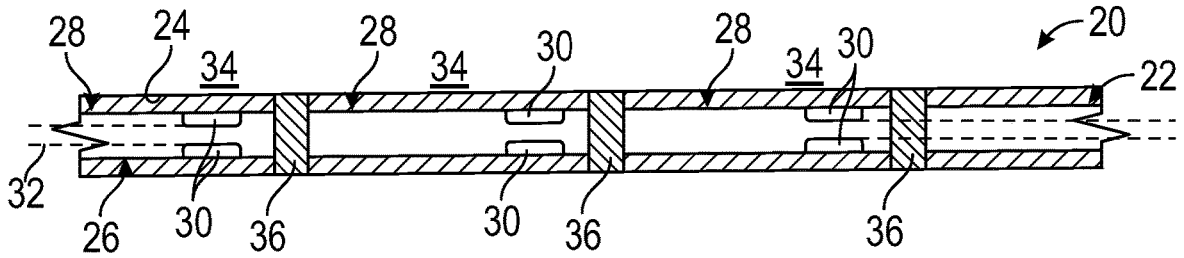
FIG. 1 is a schematic illustration of a well completion deployed in a wellbore, e.g. a horizontal wellbore, in which the well completion comprises a plurality of autonomous inflow control devices, according to an embodiment of the disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The disclosure herein generally involves a system and methodology which facilitate the inflow of wanted or desired fluids into a downhole well completion while restricting the inflow of unwanted or undesirable fluids. The technique utilizes at least one autonomous inflow control device which is placed along a well completion to control the flow of fluid from an exterior to an interior of the well completion. For example, a plurality of the autonomous inflow control devices may be placed along a base pipe of the well completion to control inflow of fluid from an exterior to an interior of the base pipe. In some applications, the well completion comprises a plurality of completion sections disposed along well zones of a horizontal well. At least one autonomous inflow control device is positioned along each completion section to control the inflow of fluid at each well zone.

Each autonomous inflow control device utilizes a plurality of shiftable elements which automatically shift in their relative positions based on the density of fluid in the autonomous inflow control device. This automatic shifting of the shiftable elements causes the alignment or misalignment of flow openings so as to allow free flow of a desired fluid through the autonomous inflow control device and into the interior of the completion while automatically restricting flow of an undesirable fluid. According to an embodiment, the shiftable elements may be in the form of discs rotatably mounted within an inflow control device housing. The discs automatically rotate to different relative orientations depending on the density of the fluid within the inflow control device housing. This automatic rotation aligns or misaligns openings through the discs to allow or restrict flow of fluid to an interior of the base pipe. The automatic rotation may be based solely on the density of the fluid. In an oil well application, for example, the discs or other types of shiftable elements may be selected to allow inflow of oil while restricting, e.g. blocking, inflow of unwanted/undesirable fluids such as water and/or gas. In other applications, however, a gas may be the desirable fluid and water may be the undesirable fluid.

The methodology described herein utilizes a difference between fluid density and body density of the shiftable element, e.g. density of a portion of the shiftable element. For example, certain shiftable elements of the autonomous inflow control device may have a density-controlled region selected so that the density control region is buoyant in a certain fluid or fluids while sinking in other fluids. Shiftable elements with different density-controlled regions may be combined within the autonomous inflow control device so as to automatically shift to different orientations depending on the density of the fluid within the autonomous inflow control device. The buoyancy of the different density-controlled regions relative to the particular fluid in the autonomous inflow control device causes the shiftable elements to change relative positions so as to provide an easy flow path for desired fluids, e.g. oil, and a tortuous or restricted flow path for undesirable fluids, e.g. water. In some embodiments, a seal or seals may be used between shiftable elements to enable complete shut off with respect to flow of the undesirable fluid(s).

Referring generally to FIG. 1, an example of a well system 20 is illustrated as comprising a completion system 22 deployed in a borehole 24, e.g. a horizontal wellbore. In the illustrated embodiment, completion system 22 comprises a well completion 26 having a plurality of completion sections 28, e.g. screen assemblies, coupled together and deployed along the interior of the wellbore 24. The well completion 26 comprises at least one autonomous inflow control device 30 which controls flow of fluid from an exterior of the well completion 26 to an interior of the well completion 26. The well completion 26 may utilize a variety of screens, filters, and/or other types of devices and features mounted about a base pipe 32. The at least one autonomous inflow control device 30 may be mounted along the base pipe 32 to control inflow of fluid from an exterior of the base pipe 32 to an interior passage of the base pipe 32 for production to a surface location or other suitable location.

In the example illustrated, at least one autonomous inflow control device 30 is mounted along the well completion 26, e.g. along the base pipe 32, in each completion section 28. For example, each completion section 28 may comprise a plurality of the autonomous inflow control devices 30 arranged circumferentially and/or longitudinally along the base pipe 32. In some applications, the completion sections 28 are located adjacent corresponding well zones 34 and isolated from each other via packers 36 or other suitable sealing devices.

Figure 2:
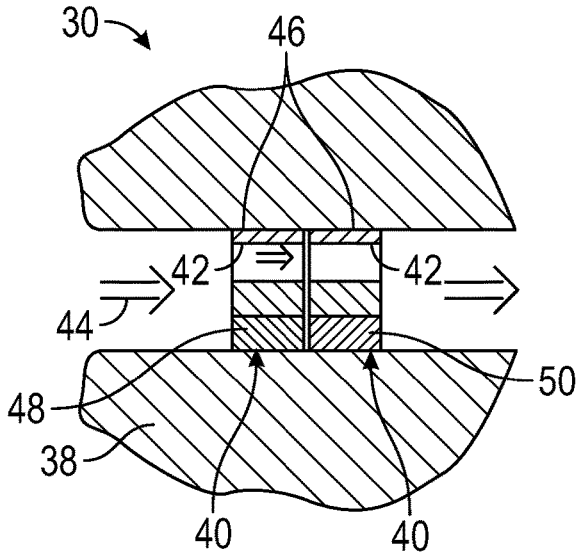
FIG. 2 is a schematic illustration of an example of an autonomous inflow control device, according to an embodiment of the disclosure.
Figure 3:
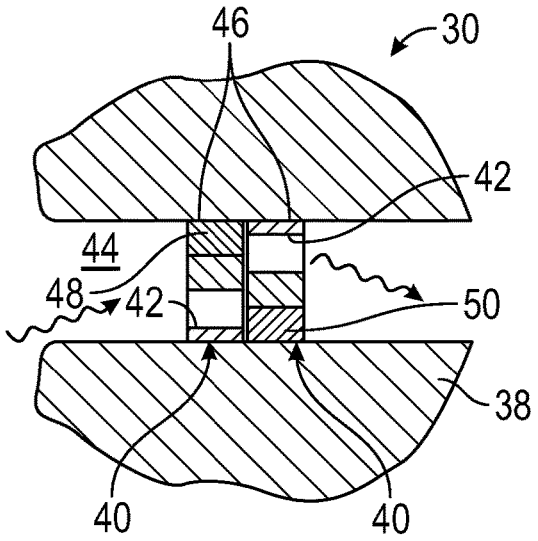
FIG. 3 is a schematic illustration similar to that of FIG. 2 but showing the autonomous inflow control device in a different operational position, according to an embodiment of the disclosure.
Figure 4:
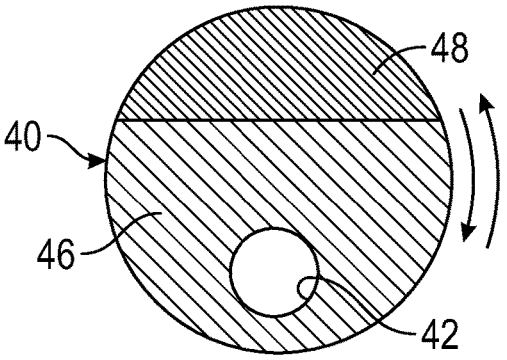
FIG. 4 is a schematic illustration of an example of a shiftable element which may be employed in the autonomous inflow control device, according to an embodiment of the disclosure.
Figure 5:
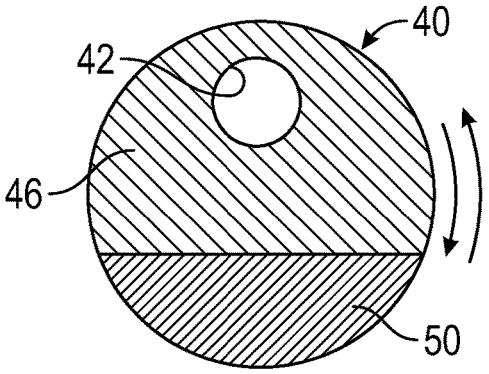
FIG. 5 is a schematic illustration of an example of another shiftable element which may be employed in the autonomous inflow control device, according to an embodiment of the disclosure.

Referring generally to FIGS. 2-5, an example of autonomous inflow control device 30 is illustrated. In this example, the autonomous inflow control device 30 comprises a device housing 38 in which shiftable elements 40 are movably located. Each shiftable element 40 has a longitudinal opening 42 therethrough and is uniquely responsive based on the density of a fluid 44 flowing into the housing 38. The shiftable elements 40 automatically respond based on the density of the fluid 44 such that the longitudinal openings 42 align in the presence of a desired fluid, e.g. oil, as illustrated in FIG. 2. However, the shiftable elements 40 shift so as to automatically misalign the longitudinal openings 42 in the presence of an undesirable fluid of a different density, e.g. water or gas, as illustrated in FIG. 3. The misalignment of openings 42 creates a tortuous path which restricts the flow of fluid therethrough.

In the embodiment illustrated, the shiftable elements 40 are in the form of discs 46 rotatably mounted in housing 38. The shiftable elements 40/discs 46 comprise density-controlled regions 48, 50 which are unique relative to each other. In other words, each density-controlled region 48, 50 is constructed with a unique density selected to cause rotation of the corresponding disk 46 to a specific orientation when the housing fills with a given fluid. By way of example, the density-controlled region 48 of the first disc 46 (see FIG. 4) may be selected to sink in oil and to float in water. In this example, the density-controlled region 50 of the second disc 46 (see FIG. 5) is selected to sink in both oil and water. The longitudinal opening 42 of each disc 46 may be positioned generally on an opposite side of the disc 46 relative to the corresponding density-controlled region 48 or 50.

As a result, when oil enters the interior of device housing 38, the density-controlled regions 48, 50 both sink and cause alignment of the longitudinal openings 42, as illustrated in FIG. 2. However, when water coning or other types of occurrences cause water to enter the interior of device housing 38, the density-controlled region 48 floats in the water and rotates the corresponding longitudinal opening 42 to a different, e.g. lower position, as illustrated in FIG. 3. However, the density-controlled region 50 of the other disc 46 retains the same orientation in the presence of water, thus causing the misalignment of longitudinal openings 42 and the resulting restriction to flow of water therethrough. It should be noted the movement of shiftable elements 40, e.g. discs 46, is due to the relative buoyancy caused by gravity acting on the density-controlled regions 48, 50 and on the fluid 44. The use of gravity in orienting the discs 46 allows the autonomous inflow control devices 30 to be self-orienting so they may be placed at a variety of orientations without affecting operation of the device.

Figure 6:
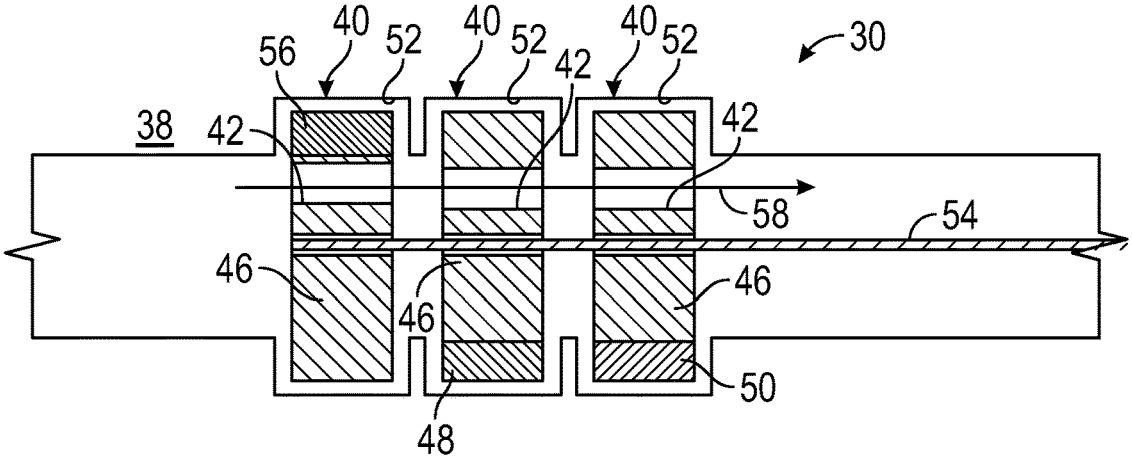
FIG. 6 is a schematic illustration of another example of an autonomous inflow control device utilizing three shiftable elements, according to an embodiment of the disclosure.

Referring generally to FIG. 6, another embodiment of autonomous inflow control device 30 is illustrated. As illustrated, the autonomous inflow control device 30 comprises at least three shiftable elements 40 which shift to different relative orientations depending on the density of the fluid within device housing 38. By way of example, the shiftable elements 40 may be in the form of discs 46 which are rotatably mounted within slots 52 formed within housing 38. In addition, or alternatively, the discs 46 may be rotatably mounted about a shaft member 54. As illustrated, the discs 46 each comprise a corresponding longitudinal opening 42 positioned at an appropriate location relative to the corresponding density-controlled region. In this embodiment, one disc 46 comprises density-controlled region 48 which floats in water and sinks in oil or gas. Another disc 46 comprises density-controlled region 50 which sinks in oil, water or gas. However, a third disc 46 comprises a density-controlled region 56 which floats in oil and water while sinking in gas.

Figure 7:
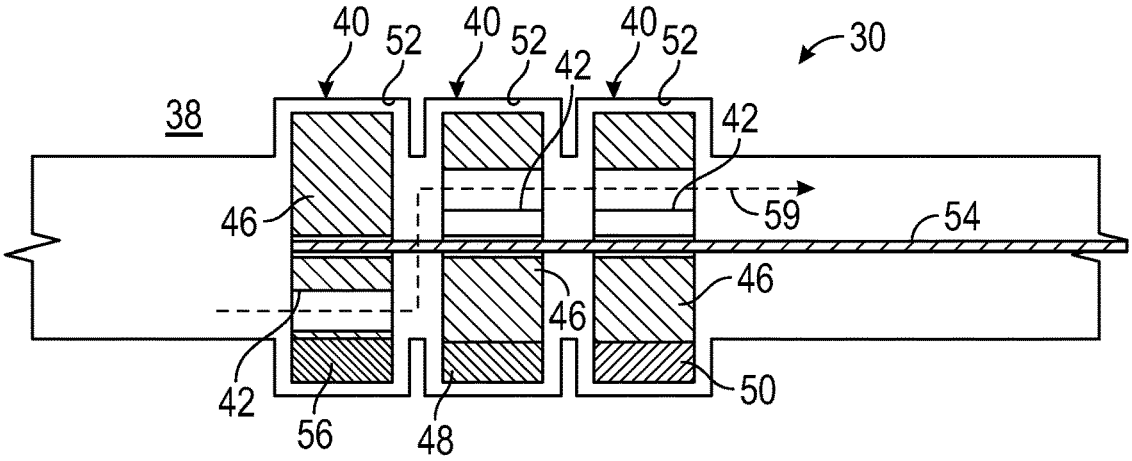
FIG. 7 is a schematic illustration similar to that of FIG. 6 but showing the autonomous inflow control device in a different operational position, according to an embodiment of the disclosure.
Figure 8:
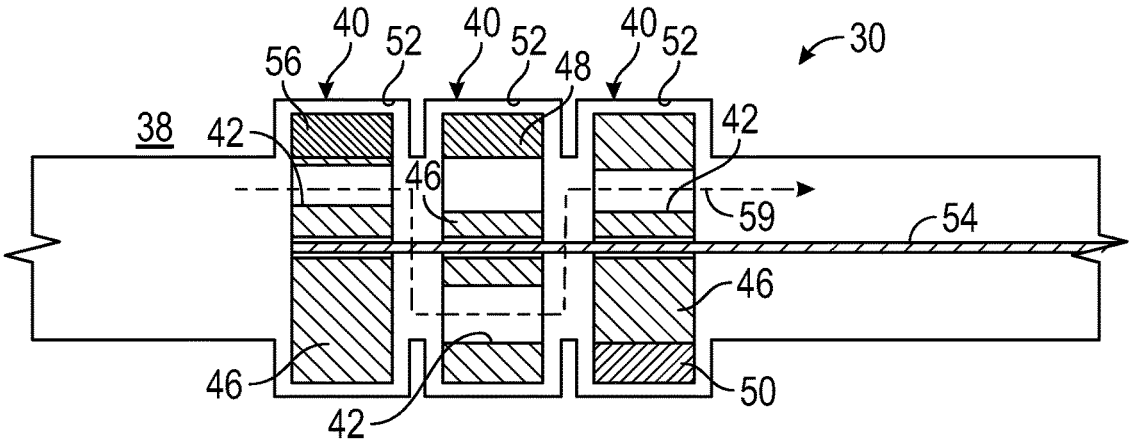
FIG. 8 is a schematic illustration similar to that of FIG. 7 but showing the autonomous inflow control device in a different operational position, according to an embodiment of the disclosure.

When oil flows into housing 38, region 56 floats while regions 48, 50 sink in the oil. The longitudinal openings 42 are positioned so as to align under these circumstances, thus allowing the oil to freely flow through the aligned openings 42 and into the interior of well completion 26, as indicated by arrow 58. However, if sufficient gas enters housing 38, the density-controlled region 56 automatically sinks which moves its corresponding longitudinal opening 42 out of alignment with the other openings 42, as illustrated in FIG. 7. This misalignment of the longitudinal openings 42 creates a tortuous path 59 which restricts the flow of gas therethrough and limits or blocks the amount of gas able to enter the interior of well completion 26. Additionally, if sufficient water enters housing 38, the density-controlled region 48 automatically floats upwardly in the water to similarly misalign the longitudinal openings 42, as illustrated in FIG. 8. This misalignment of the longitudinal openings 42 once again creates another tortuous path 59 which restricts the flow of water therethrough and limits or blocks the amount of water able to enter the interior of well completion 26. It should be noted the "desirable" fluid may vary and gas, for example, may be desirable in some applications. In such applications, the density-controlled regions, e.g. regions 48, 50, 56, and the relative positions of longitudinal openings 42 may be selected to facilitate the free flow therethrough of gas while restricting the flow of unwanted fluids, e.g. water.

Figure 9:
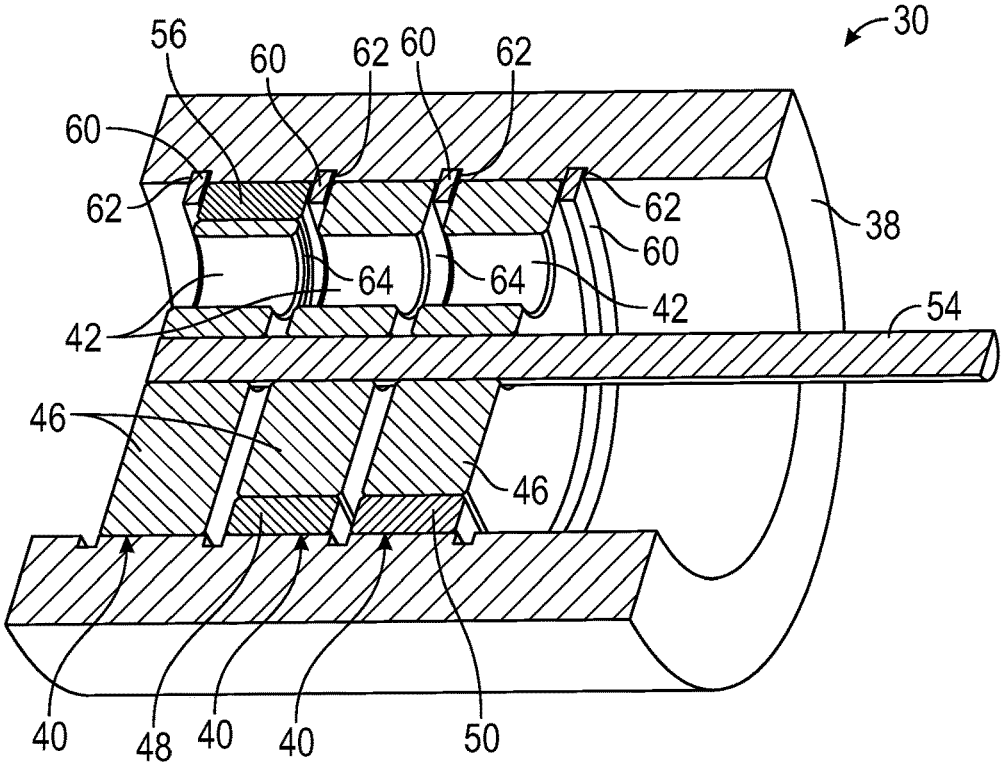
FIG. 9 is an orthogonal, cross-sectional view of an example of an autonomous inflow control device, according to an embodiment of the disclosure.
Figure 10:
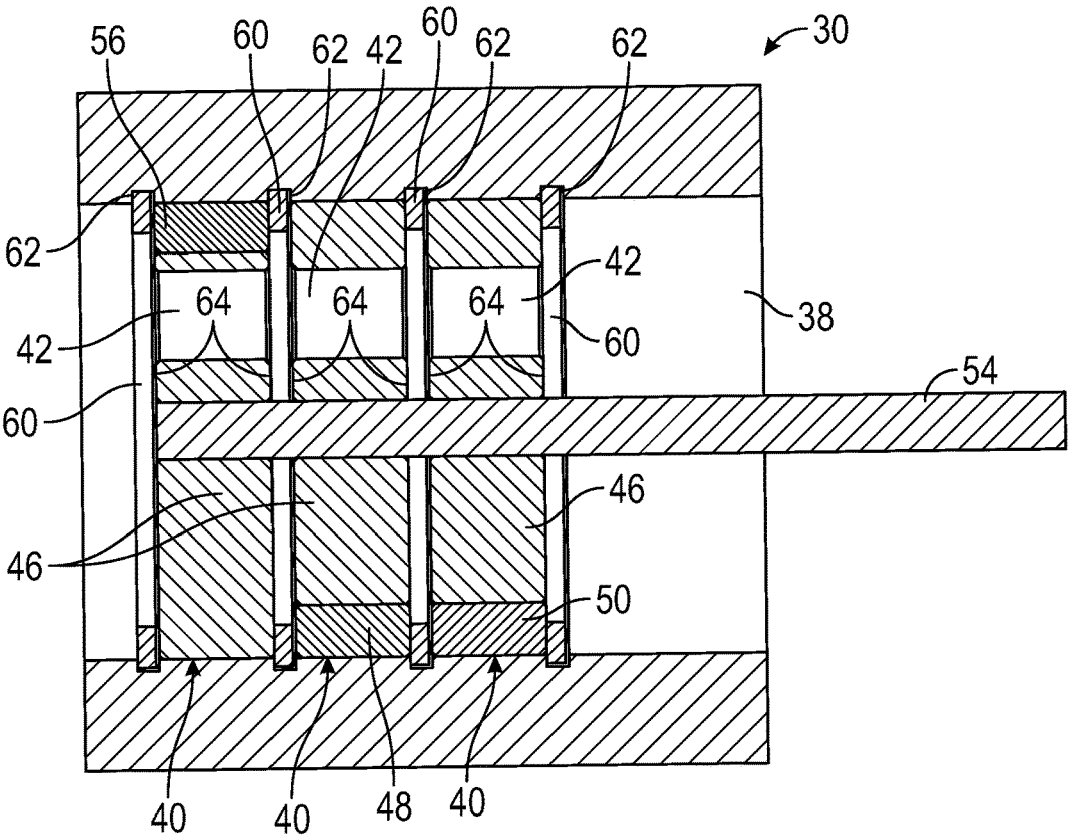
FIG. 10 is another cross-sectional view of the autonomous inflow control device illustrated in FIG. 9, according to an embodiment of the disclosure.

Referring generally to FIGS. 9 and 10, another embodiment of autonomous inflow control device 30 is illustrated. This embodiment is similar to the embodiment illustrated and described with reference to FIGS. 6-8 and similar components and features have been labeled with common reference numerals. However, the embodiment illustrated in FIGS. 9 and 10 secures the discs 46 within device housing 38 via rings 60. The rings 60 may be secured in corresponding grooves 62 formed along the interior surface of housing 38. Rings 60 are spaced appropriately to allow the discs 46 to rotate in the presence of fluids (based on the density of those fluids) while retaining the discs 46 axially at the desired position within housing 38. In some embodiments, seals 64 may be located about longitudinal openings 42 so as to completely block flow through the interior of the device housing 38 when the longitudinal openings 42 are in a misaligned position.

Figure 11:
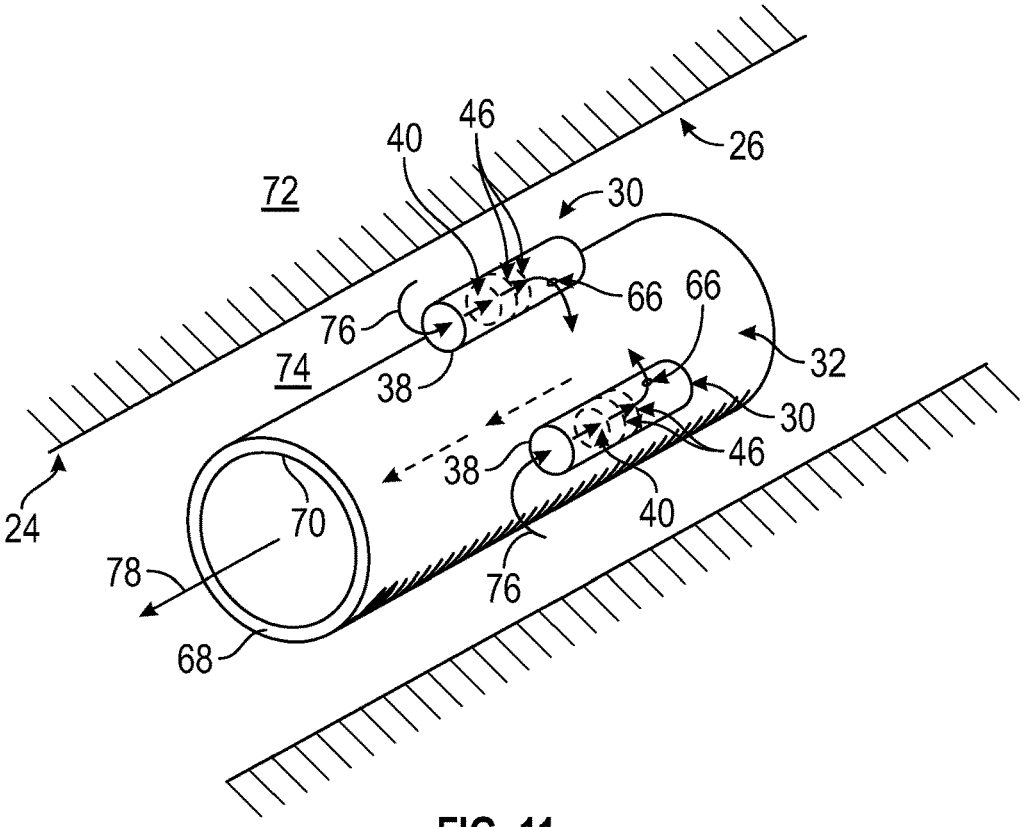
FIG. 11 is a schematic illustration of a plurality of autonomous inflow control devices mounted along a base pipe of a downhole completion, according to an embodiment of the disclosure.

Referring generally to FIG. 11, a portion of an embodiment of well completion 26 is illustrated as deployed in a horizontal wellbore 24. In this example, a plurality of the autonomous inflow control devices 30 is mounted along base pipe 32, e.g. along an exterior of the base pipe 32. The base pipe 32 has lateral openings 66, e.g. base pipe orifices, extending through a wall 68 which forms the base pipe 32. Each autonomous inflow control device 30 is mounted in fluid communication with a corresponding opening 66 (or openings 66) to control flow of well fluid from an exterior of the base pipe 32 to an interior passage 70 of the base pipe 32.

For example, fluid 44 flows from a surrounding formation 72 into wellbore 24 and specifically into an annulus 74 surrounding well completion 26. The inflowing fluid is able to enter each autonomous inflow control device 30 as indicated by inflow arrows 76. As this fluid 44 flows into the interior of the inflow control device housing 38, the shiftable elements 40, e.g. discs 46, automatically respond based on the density of fluid 44. If the fluid is oil, the shiftable elements 40/discs 46 shift to align the longitudinal openings 42 as described above. This allows the oil to freely flow through the autonomous inflow control device 30, through the lateral opening 66, and into interior passage 70 of base pipe 32 to establish a production flow 78 which may be directed to the surface or another suitable location.

If, however, the inflowing fluid 44 comprises a sufficient quantity of an undesirable fluid, e.g. water or gas, the shiftable elements 40/discs 46 shift so as to misalign the longitudinal openings 42 as described above. This automatic action restricts or blocks flow of fluid through the autonomous inflow control device 30 and thus limits or prevents production of the undesirable fluid. Each of the autonomous inflow control devices 30 is able to act independently to automatically allow or restrict inflow of fluid based solely on the density of the fluid entering the housing 38 of the autonomous inflow control device 30. Because the density-controlled regions, e.g. regions 48, 50, 56, respond based on gravity, the autonomous inflow control devices 30 may be placed at a variety of locations about the circumference of base pipe 32. The discs 46, for example, simply self-orient according to gravitational pull and automatically function regardless of their position about the circumference of the base pipe 32.

Figure 12:
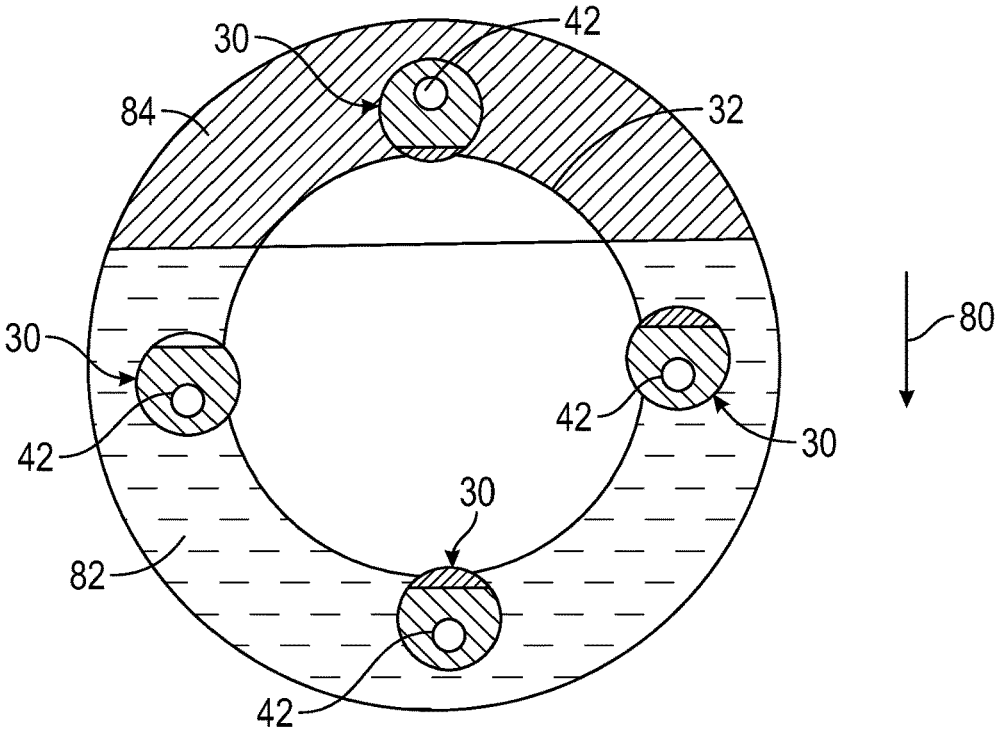
FIG. 12 is a schematic illustration of a plurality of autonomous inflow control devices mounted about the circumference of a base pipe of a downhole completion, according to an embodiment of the disclosure.

Referring generally to FIG. 12, an example is illustrated in which a plurality of autonomous inflow control devices 30, e.g. four inflow control devices 30, is arranged so that the autonomous inflow control devices 30 are positioned at different circumferential positions about the corresponding base pipe 32. In this example, the shiftable elements 40, e.g. discs 46, automatically orient to an operational position based on the gravitational pull, as indicated by arrow 80.

In this example, however, a denser undesirable fluid 82, e.g. water, has entered the horizontal wellbore 24 and forced a lighter desirable fluid 84, e.g. oil, to an upper portion of the wellbore 24. As illustrated, four autonomous inflow control devices 30 have been positioned generally circumferentially about the base pipe 32. Three of the autonomous inflow control devices 30 are illustrated as below the surface of the denser fluid 82 and have automatically shifted to a misaligned configuration in which the longitudinal openings 42 of the shiftable elements 40/discs 46 are misaligned. As a result, the flow therethrough of the undesirable, denser fluid 82 is restricted at these three devices 30. However, the uppermost autonomous inflow control device 30 is illustrated as still positioned within the desired, lighter fluid 84 (e.g. oil). Consequently, the shiftable elements/discs 46 of this uppermost device 30 are transitioned to the open flow position in which the longitudinal openings 42 are aligned, thus enabling free flow of fluid through the uppermost autonomous inflow control device 30 and into the interior passage 70 of base pipe 32. Thus, the autonomous inflow control devices 30 are able to automatically act independently so as to restrict inflow of undesirable fluid 82 while remaining open to the inflow of the desired fluid 84.

Depending on the parameters of a given well environment, wellbore, and desired versus undesirable fluids, the well completion 26 may comprise a variety of arrangements of the autonomous inflow control devices 30. For example, individual devices 30 or a plurality of devices 30 may be located in each well completion section 28 adjacent each corresponding well zone 34. The number and type of devices 30 may vary from one well completion section 28 to another. Additionally, the longitudinal and circumferential positions on the autonomous inflow control devices 30 may be adjusted according to the parameters of a given production operation. In some embodiments, multiple combinations, e.g. pairs, of discs 46 may be placed in series to create a stepped pressure drop so as to reduce forces acting at each combination of discs 46. Furthermore, additional autonomous inflow control devices 30 may be installed in, for example, an axial direction to increase the flow rate at each well completion section 28.

Additionally, the components and configurations of the autonomous inflow control devices 30 may be adjusted. For example, the shiftable elements 40 may be in the form of discs, cubes, cylinders, or other appropriate structures with corresponding supporting housing structures to enable the desired positional shifting in the presence of fluids of given densities. The density-controlled regions of each shiftable element 40 may be provided with a suitable density to cause shifting of the shiftable element 40/discs 46 when exposed to fluid of a given density. The density-controlled regions may be formed with the desired density via material selection, formation of pores or cavities, and/or other suitable techniques for achieving the desired overall density to provide appropriate corresponding action in the subject fluids. The size and overall configuration of the inflow control devices 30 as well as the various flow paths may be selected to provide desired flow rates for a given operation.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for use in a well, comprising:

a well completion for use downhole, the well completion comprising a base pipe and an autonomous inflow control device mounted along an exterior of the base pipe to control inflow of fluid from an exterior of the base pipe to an interior passage of the base pipe, the autonomous inflow control device comprising:

a housing in fluid communication with a base pipe opening extending laterally through a wall of the base pipe between the exterior and the interior passage of the base pipe, the housing including a first slot and a second slot disposed within the housing;

a first disc rotatable within the first slot of the housing, wherein the first disc includes:

a longitudinal opening extending therethrough;

a first portion including the longitudinal opening; and a second portion including a first density, wherein the first density is heavier than a density of a desired fluid and is heavier than a density of an undesired fluid; and a second disc rotatable within the second slot of the housing and rotatable independently from the first disc, wherein the second disc includes:

a longitudinal opening extending therethrough;

a first portion including the longitudinal opening; and a second portion including a second density, wherein the second density is heavier than the density of the desired fluid and is lighter than the density of the undesired fluid, wherein the first disc and second disc are configured to rotate to align the longitudinal opening of the first disc and the longitudinal opening of the second disc in the presence of the desired fluid and misalign in the presence of the undesired fluid so as to restrict flow of the undesired fluid through the longitudinal openings, thus restricting flow of the undesired fluid into the interior passage.

2. The system as recited in claim 1, wherein the first disc and the second disc are each configured to self-orient to enable mounting of the autonomous inflow control device at multiple positions around a circumference of the base pipe.

3. The system as recited in claim 1, further comprising a second autonomous inflow control device mounted along the base pipe.

4. The system as recited in claim 3, wherein the second autonomous inflow control device is mounted at a different circumferential position about the base pipe from the autonomous inflow control device.

5. The system as recited in claim 1, wherein the desired fluid comprises oil.

6. The system as recited in claim 5, wherein the undesired fluid comprises water.

7. The system as recited in claim 1, wherein the desired fluid comprises gas.

8. The system as recited in claim 1, wherein the undesired fluid comprises gas and water.

9. The system as recited in claim 1, wherein the second density is selected to float in water and to sink in oil.

10. The system as recited in claim 1, wherein the second density is selected to float in oil and to sink in gas.

11. The system as recited in claim 1, wherein the first density is selected to sink in water, oil, and gas.

12. A system for use in a well, comprising:

an autonomous inflow control device to control inflow of fluid to an interior of a well completion, the autonomous inflow control device comprising:

a housing including a first slot and a second slot disposed within the housing;

a first disc rotatable within the first slot of the housing, wherein the first disc includes:

a longitudinal opening extending therethrough;

a first portion including the longitudinal opening; and a second portion including a first density, wherein the first density is heavier than a density of a desired fluid and is heavier than a density of an undesired fluid; and a second disc rotatable within the second slot of the housing and rotatable independently from the first disc, wherein the second disc includes:

a longitudinal opening extending therethrough;

a first portion including the longitudinal opening; and a second portion including a second density, wherein the second density is heavier than the density of the desired fluid and is lighter than the density of the undesired fluid, wherein the first disc and second disc are configured to rotate to align the longitudinal opening of the first disc and the longitudinal opening of the second disc.

13. The system as recited in claim 12, wherein the autonomous inflow control device further comprises a third disc.

14. The system as recited in claim 12, wherein the second density is selected to float in water and to sink in oil.

15. The system as recited in claim 12, wherein the second density is selected to float in oil and water and to sink in gas.

16. A method, comprising:

positioning a plurality of autonomous inflow control devices along a well completion to control inflow of fluid from an exterior to an interior of the well completion, wherein the autonomous inflow control device includes:

a housing including a first slot and a second slot disposed within the housing;

a first disc rotatable within the first slot of the housing, wherein the first disc includes:

a longitudinal opening extending therethrough;

a first portion including the longitudinal opening; and a second portion including a first density, wherein the first density is heavier than a density of a desired fluid and is heavier than a density of an undesired fluid; and a second disc rotatable within the second slot of the housing and rotatable independently from the first disc, wherein the second disc includes:

a longitudinal opening extending therethrough;

a first portion including the longitudinal opening; and a second portion including a second density, wherein the second density is heavier than the density of the desired fluid and is lighter than the density of the undesired fluid, wherein the first disc and second disc are configured to rotate to align the longitudinal opening of the first disc and the longitudinal opening of the second disc;

and flowing a desired fluid through the autonomous inflow control device to align the longitudinal opening of the first disc and the longitudinal opening of the second disc to thus allow open flow therethrough of the desired fluid while restricting flow of the undesired fluid.

17. The method as recited in claim 16, further comprising deploying the well completion downhole into a horizontal wellbore.

* * * * *